US008752902B2

(12) United States Patent
Labish

(10) Patent No.: US 8,752,902 B2
(45) Date of Patent: Jun. 17, 2014

(54) SEATING TRIM ATTACHMENT RETAINER FOR EPP/EPS AND POLYURETHANE FOAM

(75) Inventor: John Vincent Labish, Macomb, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 678 days.

(21) Appl. No.: 12/942,165

(22) Filed: Nov. 9, 2010

(65) Prior Publication Data

US 2012/0112515 A1 May 10, 2012

(51) Int. Cl.
*A47C 7/02* (2006.01)

(52) U.S. Cl.
USPC ..... 297/452.6; 297/218.2; 297/452.58; 297/452.61; 297/452.62; 297/457

(58) Field of Classification Search
USPC ..... 297/218.2, 452.58, 452.6, 452.61, 297/452.62, 457; 24/289
See application file for complete search history.

(56) References Cited

U.S. PATENT DOCUMENTS 4,789,201 A 12/1988 Selbert
4,920,618 A * 5/1990 Iguchi ..... 24/453
5,669,129 A * 9/1997 Smith et al. ..... 29/91.1
5,733,001 A 3/1998 Roberts
5,758,924 A * 6/1998 Vishey ..... 297/284.4
5,882,073 A * 3/1999 Burchi et al. ..... 297/218.2
5,964,017 A * 10/1999 Roberts ..... 29/91.1
6,804,864 B2 * 10/2004 Kirchen et al. ..... 24/297
6,899,399 B2 5/2005 Ali et al.
6,964,453 B1 * 11/2005 Flegal et al. ..... 297/452.6
7,134,730 B2 * 11/2006 Flegal et al. ..... 297/452.6
7,323,236 B2 * 1/2008 Dexheimer et al. ..... 428/99
7,506,939 B2 * 3/2009 Brockschneider et al. 297/452.6
2002/0101109 A1 8/2002 Stiller et al.
2006/0061192 A1 * 3/2006 Flegal et al. ..... 297/452.6
2009/0033131 A1 * 2/2009 Clauser et al. ..... 297/218.4
2009/0066142 A1 3/2009 Ventura et al.
2009/0295215 A1 * 12/2009 Galbreath et al. ..... 297/452.6

FOREIGN PATENT DOCUMENTS

EP 240388 A2 * 10/1987 ..... A47C 31/02
WO 2009092153 A1 7/2009

* cited by examiner

*Primary Examiner* — Laurie Cranmer
(74) *Attorney, Agent, or Firm* — Vichit Chea; Price Heneveld LLP

(57) ABSTRACT

A trim attachment retainer having a body portion including a proximal end and an engagement end. At least one cross member is integral with and substantially orthogonal to the body portion. At least one barb extends from the engagement end. The at least one barb includes a base and a distal end. The distal end is closer than the base to the at least one cross member.

12 Claims, 5 Drawing Sheets

SEATING TRIM ATTACHMENT RETAINER FOR EPP/EPS AND POLYURETHANE FOAM

FIELD OF THE INVENTION

The present invention generally relates to a seating trim attachment retainer, and more particularly relates to a seating trim attachment retainer for EPP/EPS and polyurethane foam.

BACKGROUND OF THE PRESENT INVENTION

Connecting coverstock material over vehicle seats can be done in any of a number of ways. The coverstock material is needed to be fixed in place over the seating unit in a vehicle to prevent the coverstock material from tearing or bunching when in use.

SUMMARY OF THE PRESENT INVENTION

One aspect of the present invention includes a trim attachment retainer having a body portion including a proximal end and an engagement end. At least one cross member is integral with and substantially orthogonal to the body portion. At least one barb extends from the engagement end. The at least one barb includes a base and a distal end. The distal end is closer than the base to the at least one cross member.

Another aspect of the present invention includes a trim attachment structure for a vehicle seat having a coverstock material. A retainer is operably connected to the coverstock material. The retainer includes a body portion with a proximal end and an engagement end and is integrally connected with a cross member by a living hinge. A salvage trench is disposed in the vehicle seat. The salvage trench includes an inner recess adapted to receive the engagement end.

Yet another aspect of the present invention includes a method of making a method of securing a coverstock to a vehicle seat including forming a salvage trench in a vehicle seat structure. A retainer is formed having a body portion with a proximal end, an engagement end, and at least one cross member. A living hinge is formed between the cross member and the body portion. A coverstock material is connected to the proximal end. The engagement end of the retainer is inserted into the salvage trench.

These and other aspects, objects, and features of the present invention will be understood and appreciated by those skilled in the art upon studying the following specification, claims, and appended drawings.

DETAILED DESCRIPTION OF EMBODIMENTS

Figure 1:
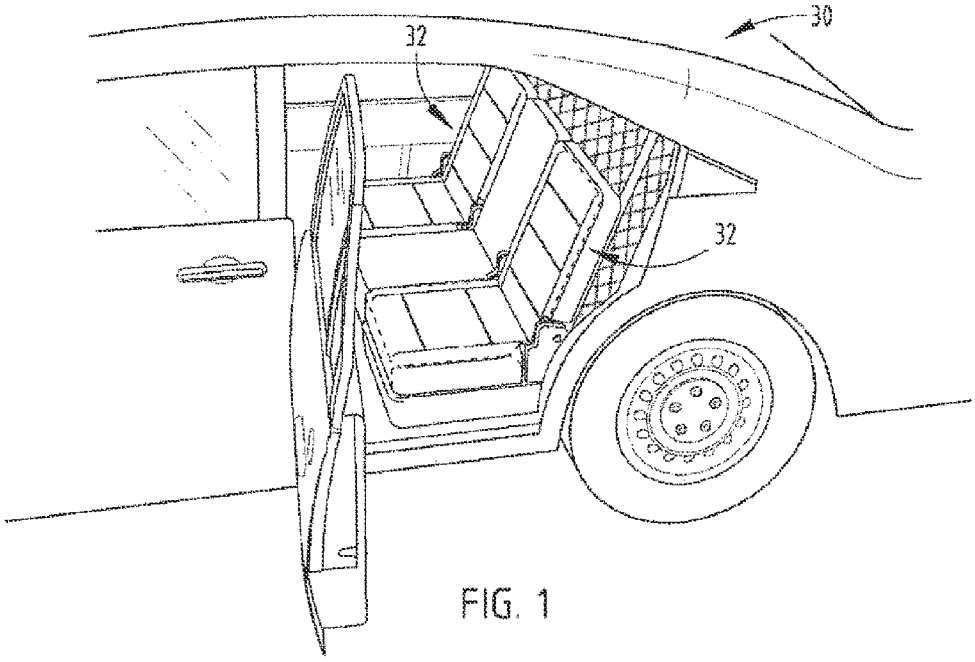
FIG. 1 is a top perspective view of one embodiment of a vehicle incorporating one embodiment of the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
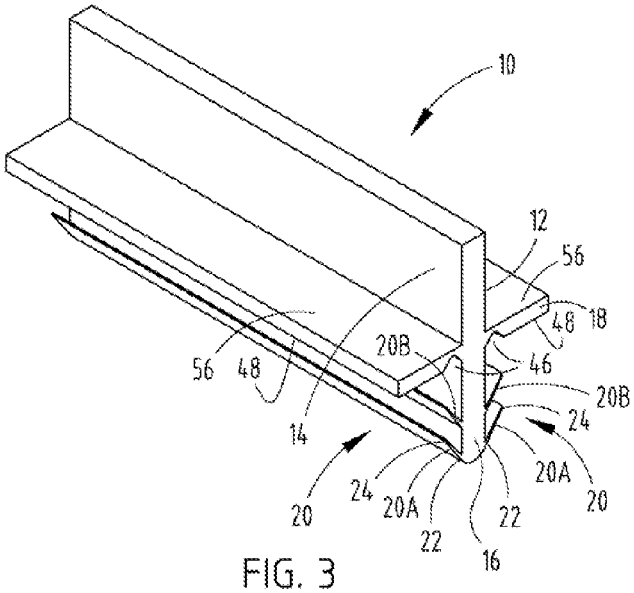
FIG. 3 is a top perspective view of one embodiment of a trim attachment retainer.
Figure 4:
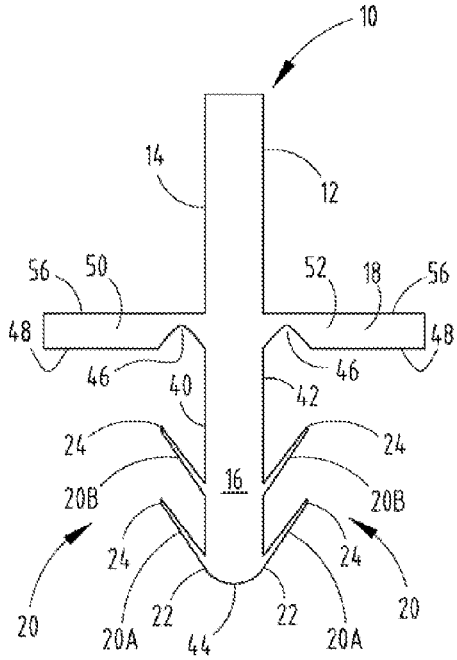
FIG. 4 is a side elevational view of the trim attachment retainer of FIG. 3.

Referring now to FIGS. 1, 3, and 4, the reference numeral 10 generally designates a trim attachment retainer having a body portion 12 including a proximal end 14 and an engagement end 16. At least one cross member 18 is integral with and substantially orthogonal to the body portion 12. At least one barb 20 extends from the engagement end 16. The at least one barb 20 includes a base 22 and a distal end 24. The distal end 24 is closer than the base 22 to the at least one cross member 18.

Figure 2:
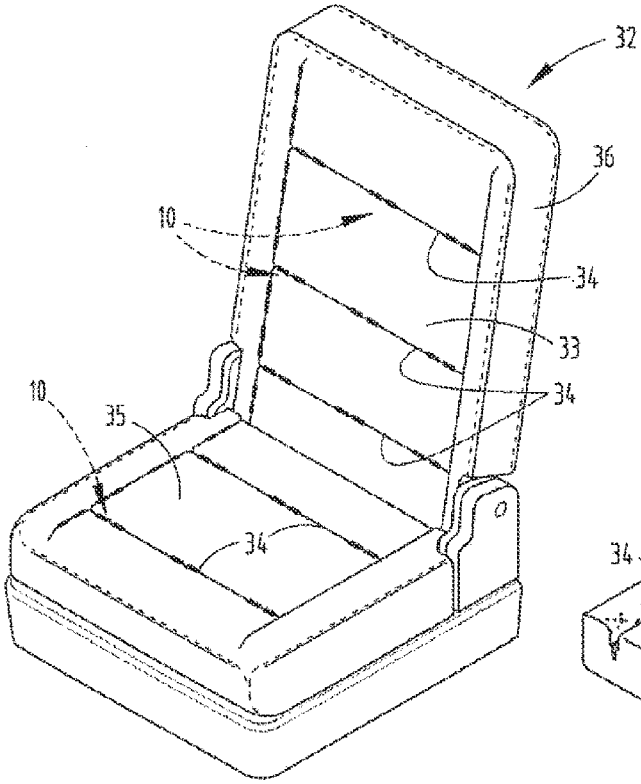
FIG. 2 is a top perspective view of a vehicle seat incorporating one embodiment of a trim attachment retainer of the present invention.
Figure 2A:
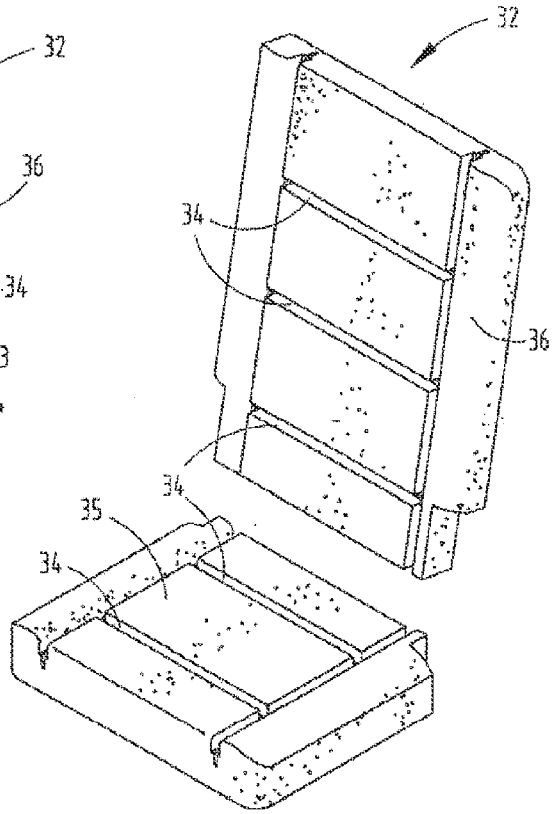
FIG. 2A is a top perspective exploded view of a foam portion of the vehicle seat of FIG. 2.

Referring to FIGS. 1-2A, the trim attachment retainer 10 is generally designed for use in law enforcement vehicles 30 on seating units 32 that carry suspects. The trim attachment retainer 10 is designed for use with a variety of rigid foam seat units 32 constructed from EPP, EPS, and polyurethane. There may be one or more of the seating units 32 positioned in the law enforcement vehicle 30. The illustrated seating unit 32 is one example of a seating construction. Other constructions are also contemplated. The trim attachment retainer 10 is designed to be sewn to a seat cover or coverstock material 33, as will be disclosed in further detail below, and inserted into a vertical or horizontal salvage trench 34 formed in the vehicle seat unit 32. In addition, the trim attachment retainer 10 can be used in a seat 35 or seat back 36 of the vehicle seat unit 32.

As shown in FIGS. 3 and 4, one embodiment of the present invention includes the body portion 12 of the trim attachment retainer 10 being generally linear and the cross member 18 generally linear. The body portion 12 and cross member 18 are generally orthogonally aligned. The engagement end 16 of the body portion 12 includes the barbs 20. It is contemplated that one or more barbs 20 may be disposed on a first side 40 of the engagement end 16, and one or more barbs 20 may also be disposed on a second side 42 of the engagement end 16. The engagement end 16 includes a rounded distal tip 44 that allows for easy insertion of the trim attachment retainer 10 into the salvage trench 34 of the vehicle seat unit 32. In the illustrated embodiment, lower barbs 20A are positioned proximate the rounded distal tip 44. Upper barbs 20B are positioned between the lower barbs 20A and the cross member 18. The barbs 20A, 20B are angled away from the rounded distal tip 44. The distal end 24 of the barbs 20A, 20B may be tapered to a point or have a squared end.

Referring again to the embodiment of FIGS. 3 and 4, a slot 45 is disposed on a bottom side 48 of the cross member 18 proximate the body portion 12 of the trim attachment retainer 10. The slot 45 defines a living hinge 46 in the cross member 18. More specifically, the living hinge 46 allows flexibility to a first cross member portion 50 of the cross member 18, as well as a second cross member portion 52 of the cross member 18, such that during installation of the trim attachment retainer 10 into the salvage trench 34, the first cross member portion 50 and the second cross member portion 52 can flex upwardly and maintain that position when the trim attachment retainer 10 is fully installed, as will be disclosed in more detail below.

Figure 5:
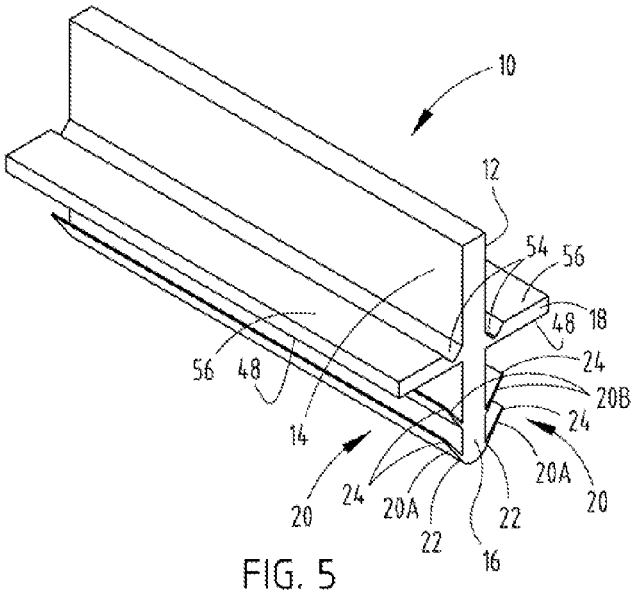
FIG. 5 is a top perspective view of another embodiment of a trim attachment retainer.
Figure 6:
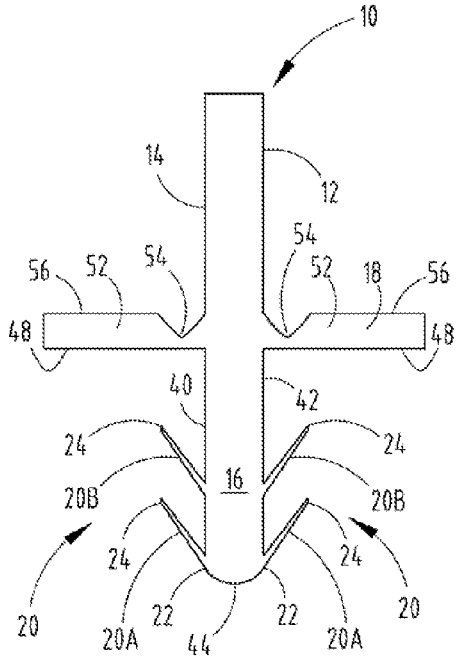
FIG. 6 is a side elevational view of the trim attachment retainer of FIG. 5.

In another embodiment of the present invention, as shown in FIGS. 5 and 6, a living hinge 54 is disposed on a top side 56 of the cross member 18 to allow flexure of the first cross member portion 50 and second cross member portion 52 of the cross member 18 during installation of the trim attachment retainer 10 into the salvage trench 34. The construction of the trim attachment retainer 10 is otherwise similar to the construction shown in FIGS. 3 and 4. It will be noted that the length of the cross member 18 and length of the body portion 12 may be of varying lengths to suitably meet the size requirements of the salvage trench 34 disposed in the vehicle seat unit 32.

Figure 7:
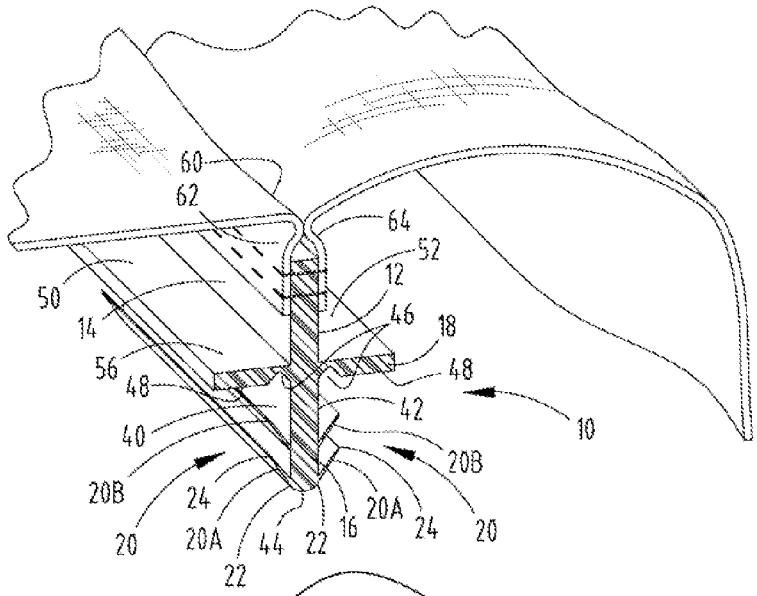
FIG. 7 is a top perspective view of a trim attachment retainer operably coupled with a coverstock material prior to insertion into a salvage trench.
Figure 7:
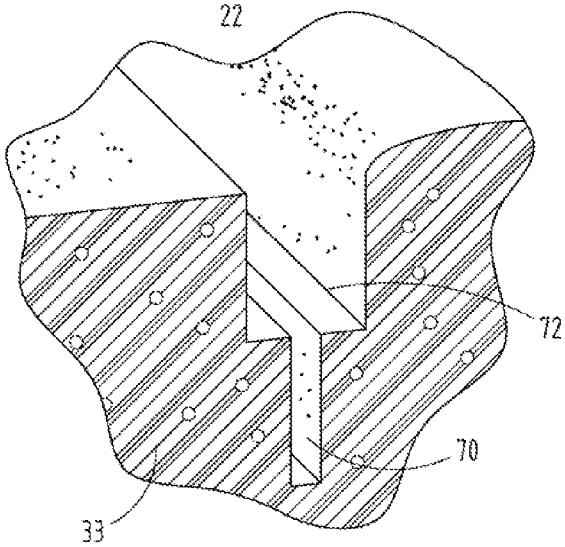
Figure 7A:
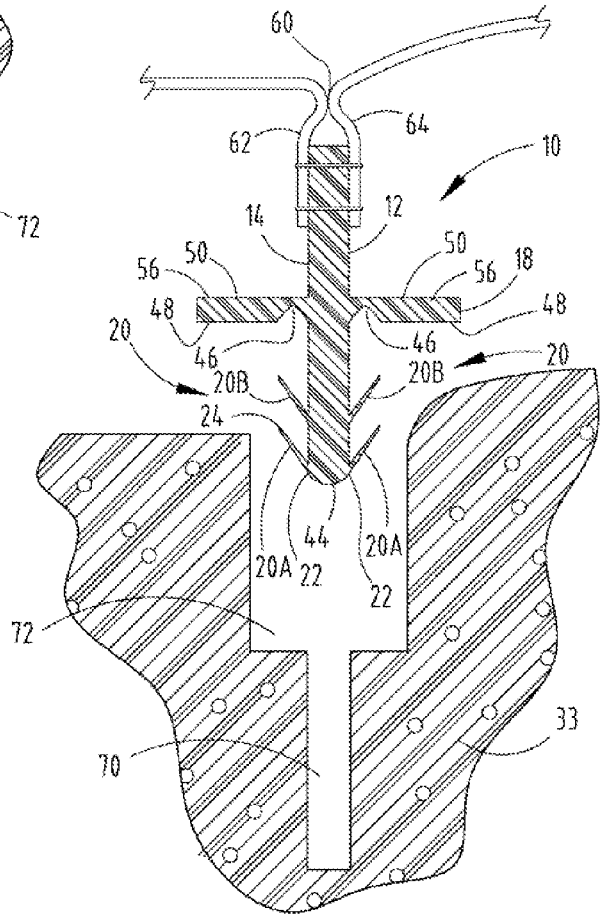
FIG. 7A is a side elevational view of the trim attachment retainer of FIG. 7 prior to insertion into the salvage trench.
Figure 8:
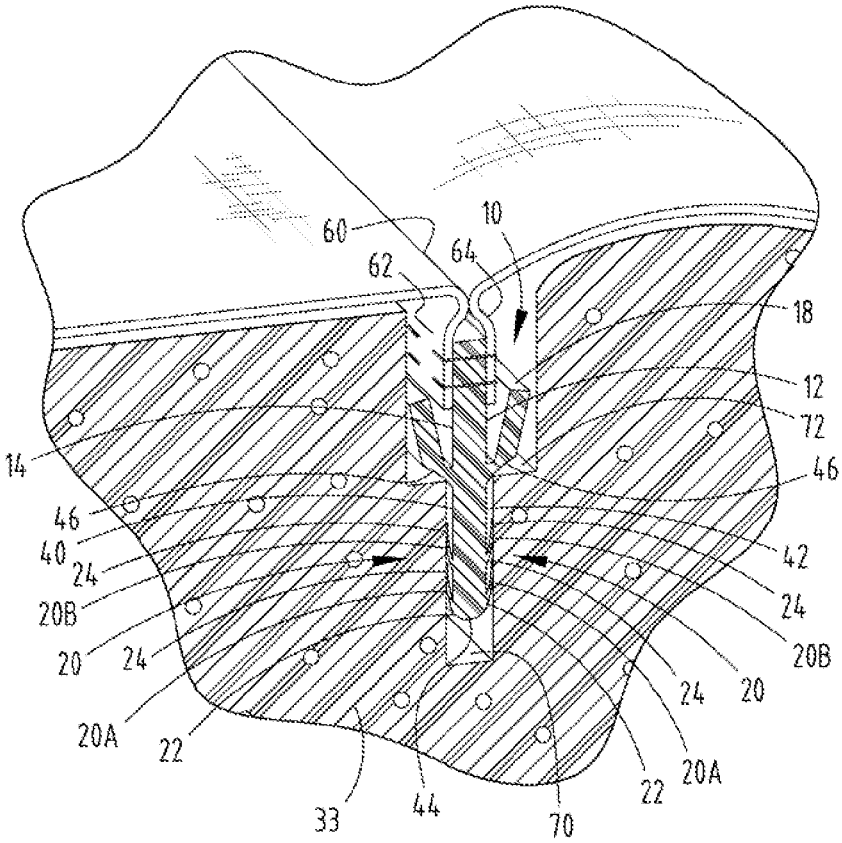
FIG. 8 is a top perspective view of a trim attachment retainer operably coupled with a coverstock material and inserted into a salvage trench.
Figure 8A:
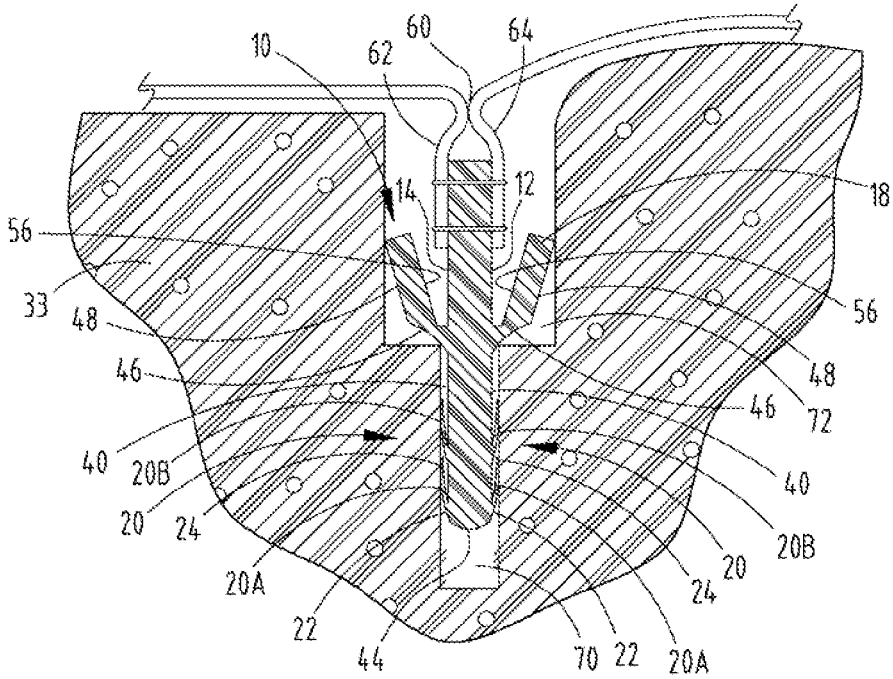
FIG. 8A is a side elevational view of the trim attachment retainer of FIG. 8 fully inserted into the salvage trench of the vehicle seat structure.

Referring now to FIGS. 7-8A, during installation, a seam 60 in the coverstock material 33 is sewn to the proximal end 14 of the body portion 12 of the trim attachment retainer 10. It is contemplated that first and second flaps 62, 64 of the seam 60 may be disposed on either side of the proximal end 14 of the trim attachment retainer 10, or both on the same side of the proximal end 14 of the trim attachment retainer 10. After the proximal end 14 has been sewn to the seam 60 of the coverstock material 33, the trim attachment retainer 10 is aligned with the salvage trench 34 in the vehicle seat unit 32. Once the trim attachment retainer 10 has been aligned with the salvage trench 34, the trim attachment retainer 10 is inserted downward into a narrow portion 70 of the salvage trench 34 until the cross member 18 abuts a wide portion 72 of the salvage trench 34. The first and second cross member portions 50, 52 of the cross member 18 are then allowed to flex upwardly by way of the living hinge 46 disposed between the cross member 18 and the body portion 12 of the trim attachment retainer 10. The barbs 20 disposed on the engagement end 16 of the trim attachment retainer 10 allow the engagement end 16 of the body portion 12 of the trim attachment retainer 10 to be easily inserted into the narrow portion 70 of the salvage trench 34. However, because the distal end 24 of the barb 20 is disposed closer to the cross member 18 than the base 22 of each barb 20 (stated differently, the barbs 20 are angled in a direction away from the angle of insertion of the trim attachment retainer 10), once the engagement end 16 has been fully inserted into the narrow portion 70 of the salvage trench 34, the barbs 20 deter disengagement of the trim attachment retainer 10 from the narrow portion 70 of the salvage trench 34, thus retaining the coverstock material 33 in position over the vehicle seat unit 32.

Figure 9:
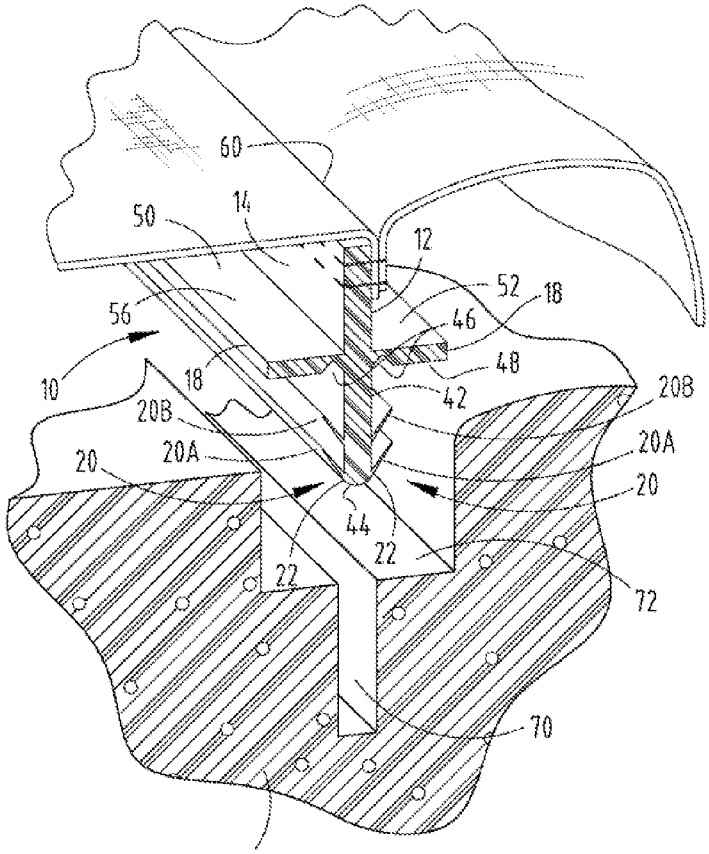
FIG. 9 is a top perspective view of another embodiment of a trim attachment retainer operably coupled with a coverstock material and inserted into a salvage trench.
Figure 9A:
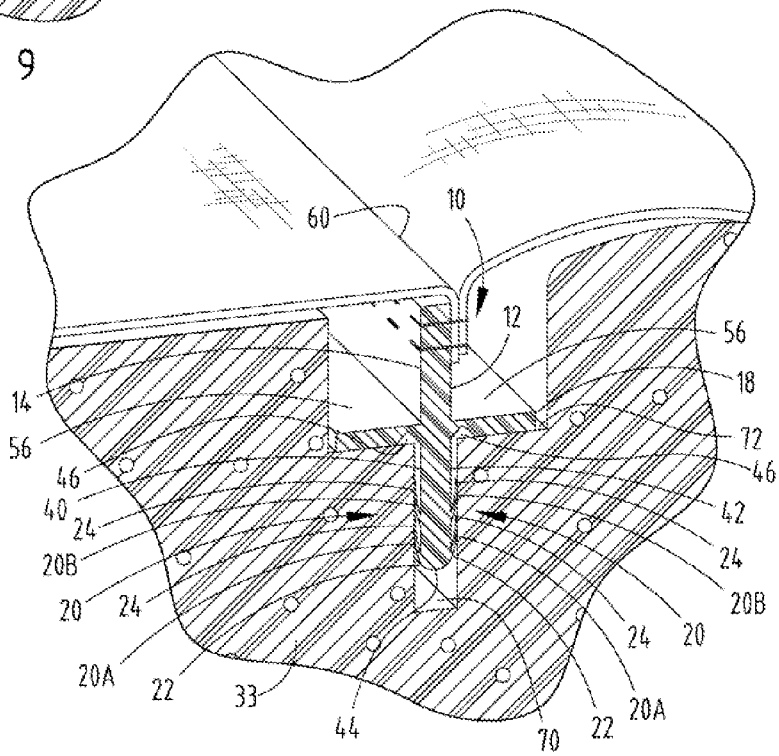
FIG. 9A is a side elevational view of the trim attachment retainer of FIG. 9 fully inserted into the salvage trench of the vehicle seat structure.

Referring now to FIGS. 9 and 9A, yet another embodiment of the present invention includes the trim attachment retainer 10 that includes a shortened cross member 18. The cross member 18 of this embodiment has a length that is slightly less than the width of the wide portion 72 of the salvage trench 34. Accordingly, the cross member 18 is designed to fit, without bending, across the wide portion 72 of the salvage trench 34. Accordingly, the first and second cross member portions 50, 52 of the cross member 18 may be inserted into the salvage trench 34 without the first and second cross member portions 50, 52 bending at the living hinge 46. The barbs 20 otherwise interface with the narrow portion 70 of the salvage trench 34 in the same manner as the previous embodiment. In addition, it is contemplated that the seam 60 of the coverstock material 33 may be attached on one side of the proximal end 14 of the body portion 12, as shown in FIGS. 9 and 9A. It is generally contemplated that the seam 60 of the coverstock material 33 may be positioned on either a forward side or a rearward side of the proximal end 14 of the body portion 12.

It is to be understood that variations and modifications can be made on the aforementioned structure without departing from the concepts of the present invention, and further it is to be understood that such concepts are intended to be covered by the following claims unless these claims by their language expressly state otherwise.

What is claimed is:

1. A trim attachment retainer comprising:

a body portion having a proximal end and an engagement end;

at least one cross member integral with and substantially orthogonal to the body portion;

first and second barbs vertically aligned on and extending from the engagement end, the first and second barbs having a base and a distal end, wherein the distal end is closer than the base to the at least one cross member; and a slot disposed proximate the intersection of the at least one cross member and one of the proximal end and the engagement end, the slot defining a living hinge.

2. The trim attachment retainer of claim 1, wherein the at least one cross member includes a first cross member disposed on a first side of the body portion and a second cross member disposed on a second side of the body portion.

3. The trim attachment retainer of claim 1, wherein the proximal end is operably coupled with a coverstock material.

4. A trim attachment structure for a vehicle seat, comprising:

a coverstock material;

a retainer operably connected to the coverstock material, the retainer including a body portion with a proximal end and an engagement end having first and second barbs and integrally connected with a cross member by a living hinge; and a salvage trench disposed in said vehicle seat, wherein the salvage trench includes an inner recess adapted to receive the engagement end.

5. The trim attachment structure for a vehicle seat of claim 4, further comprising:

a first barb protruding from a first side of the engagement end and a second barb extending from a second side of the engagement end.

6. The trim attachment structure for a vehicle seat of claim 4, wherein the cross member includes a first cross member disposed on a first side of the body portion and a second cross member disposed on a second side of the body portion.

7. The trim attachment structure for a vehicle seat of claim 4, further comprising:

a slot disposed proximate the intersection of the cross member and the proximal end, wherein the slot defines the living hinge.

8. The trim attachment structure for a vehicle seat of claim 4, further comprising:

a slot disposed proximate the intersection of the cross member and the engagement end, wherein the slot defines the living hinge.

9. A method of securing a coverstock to a vehicle seat comprising:

forming a salvage trench in a vehicle seat structure;

forming a retainer having a body portion with a proximal end, an engagement end with a barb, and a cross member;

forming a living hinge between the cross member and the body portion;

connecting a coverstock material to the proximal end; and inserting the engagement end of the retainer into the salvage trench.

10. The method of claim 9, further comprising:

forming an inner slot in the salvage trench adapted to receive the engagement end of the body portion of the retainer.

11. The method of claim 9, wherein the step of forming a living hinge further comprises:

forming a slot at an intersection of the cross member and the engagement end of the body, the slot defining the living hinge.

12. The method of claim 9, wherein the step of forming a living hinge further comprises:

forming a slot at an intersection of the cross member and the proximal end of the body, the slot defining the living hinge.

* * * * *